United States Patent [19]

Kindig et al.

[11] 3,961,914

[45] June 8, 1976

[54] PROCESS FOR TREATING COAL TO MAKE IT RESISTANT TO SPONTANEOUS COMBUSTION

[75] Inventors: James K. Kindig, Arvada; Ronald L. Turner, Lakewood, both of Colo.

[73] Assignee: Hazen Research, Inc., Golden, Colo.

[22] Filed: July 26, 1974

[21] Appl. No.: 492,257

[52] U.S. Cl. ..... 44/1 R; 44/6

[51] Int. Cl.[2] ..... C10L 9/00

[58] Field of Search ..... 44/1 R, 1 F, 1 G, 6, 44/16 C, 16 E; 252/446

[56] References Cited

UNITED STATES PATENTS

| | | | |
|---|---|---|---|
| 869,043 | 10/1907 | Arden | 75/42 |
| 1,496,004 | 6/1924 | Laist | 423/109 |
| 1,670,865 | 5/1928 | Miller | 44/16 E |
| 1,834,960 | 12/1931 | Mitchell | 423/106 |
| 1,973,300 | 9/1934 | Thompson, Jr. | 423/544 |
| 2,347,140 | 4/1944 | Weimer | 44/1 R |
| 2,991,201 | 7/1961 | Joyce | 252/446 X |
| 3,434,947 | 3/1969 | Steintueit | 423/140 |
| 3,684,490 | 8/1972 | Steintueit | 423/109 |
| 3,781,405 | 12/1973 | Allan et al. | 423/633 |

OTHER PUBLICATIONS

Rastas, J. et al., *Treatment of Iron Residues in the Electrolytic Zinc Process*, TMS Paper Selection A73–11, The Metallurgical Society of Aime, NY, NY.

*Primary Examiner*—Carl F. Dees

*Attorney, Agent, or Firm*—Sheridan, Ross & Fields

[57] ABSTRACT

Coal particles are made resistant to spontaneous combustion by coating them with silicon dioxide by a vapor deposition process in which the particles in a coating chamber are contacted at a temperature that promotes the deposition on the particles of the reaction products between silicon tetrachloride vapor and water, the coating step followed by elevating the chamber temperature to drive off water vapor and hydrochloric acid.

16 Claims, 1 Drawing Figure

TIME-TEMPERATURE RESPONSE OF COAL SUBJECTED TO HOT WATER-SATURATED OXYGEN
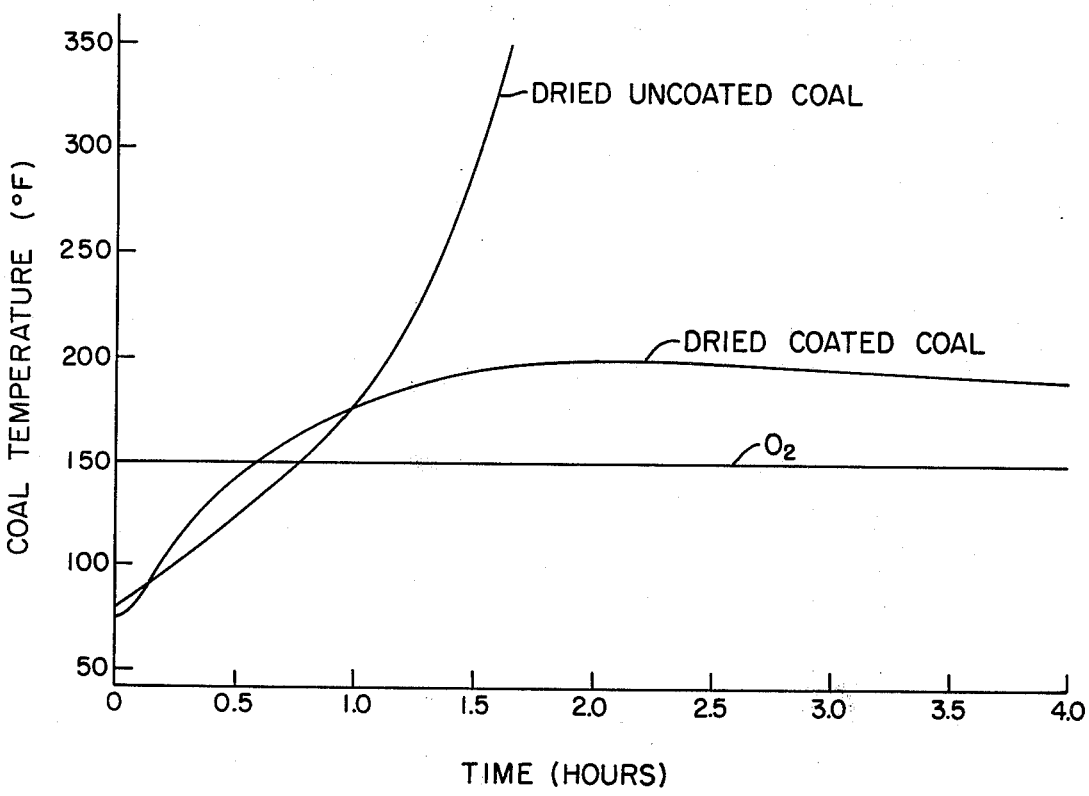

PROCESS FOR TREATING COAL TO MAKE IT RESISTANT TO SPONTANEOUS COMBUSTION

BACKGROUND OF THE INVENTION

1. Field of the Invention

The invention relates generally to a process for improving coal to make it less susceptible to spontaneous combustion. Particularly, the process of the invention relates to coating coal particles with an incombustible coating, specifically, silicon dioxide.

2. Status of the Industry

The rapid growth of electrical demand in the United States, the concern for low sulfur dioxide emissions from power plants, and the national goal for energy self-sufficiency have all fostered an unprecedented boom in Western coal. This low-rank, low sulfur, high-moisture coal is now shipped by unit trains carrying 10,000 tons of coal thousands of miles to Eastern and Southern electrical utilities.

There are certain disadvantages in shipping and storing low rank coal. First of all, Western coals frequently contain 25% or more inherent moisture, and the shipping cost for transporting this much moisture in large shipments is significant. Secondly, all coals and especially low-rank coals have a tendency to ignite spontaneously during shipping or storage. Thirdly, low-rank coals are usually quite dusty, even through they may contain 25% inherent moisture.

3. Prior Art

In an article entitled "Self-Heating of Carbonaceous Materials" by F. L. Shea, Jr., and H. L. Hsu, Great Lakes Research Corporation, Elizabethton, Tennessee, the authors reported the development of a simple test for the determination of the self-heating rates of various carbonaceous materials. They state that their test, which provides for contact between oxygen at 150°F (66°C) saturated with water vapor and materials which contain sufficient hydrocarbons to combine with oxygen at around 300°F (149°C) and thus ignite at relatively low temperatures, provides a good measure of the liability of the material to spontaneously ignite. The effect of moisture in the self-heating process is extremely important. This was well illustrated by the behavior of raw lignite which, in the presencee of dry oxygen at 150°F (66°C) experienced a temperature rise of only 18°F (10°C) inabout five hours while in the presence of oxygen saturated with water vapor at 150°F (66°C) the rate of temperature rise was on the order of tenfold greater, with the lignite igniting in less than 5 hours.

U.S. Pat. No. 3,723,079 discloses a process for "stabilizing" dried lignitic and subbituminous coals against spontaneous combustion, in which the dried coal is treated at about 347°F (175°C) to 437°F (225°C) with oxygen followed by some rehydration of the oxygen-treated coal with water. The test, which the inventors used to measure the stability of the coals treated by their process described in the above patent, was essentially the same test as developed by Shea and Hsu as described above.

While coal can be thermally dried below its inherent moisture value, this has disadvantages. The product has perhaps a even greater tendency toward spontaneous ignition than undried coal, it is dustier, and under humid conditions it will reabsorb moisture.

U.S. Pat. No. 3,723,079 described previously, discloses a process for stabilizing a coal against spontaneous combustion; however, the treatment requires addition of water which materially offsets the advantages of drying.

U.S. Pat. No. 3,014,815 discloses a process for coating articles with a metal oxide by introducing into a coating chamber containing the articles a hydrolysable metal compound,, which may be the chloride of the metal, oxygen, and hydrogen or a compound which produces hydrogen. The chloride is hydrolysed by the water formed to produce the metal oxide with which the article is coated. The patent does not disclose coating coal and does not disclose the use of silicon dioxide as coating material. Further, and most important, the source of water required for the process is oxygen and a compound which reacts with oxygen to form water; the formation of water by this method requires heating the articles to at least approximately 1112°F (600°C).

SUMMARY OF THE INVENTION

The principal object of the present invention is to improve coal by making it less susceptible to spontaneous combustion or even entirely resistant to spontaneous combustion. A more particular object is to provide a process for coating particulate coal with an incombustible coating.

Another object of this invention is to provide an incombustible coating on the dried coal particles to make them substantially resistant to spontaneous combustion. Additionally the invention helps allay the dust problem and slows down the reabsorption of water vapor.

The above and other objects are accomplished by coating coal particles with silicon dioxide in a vapor deposition process in which the particles in a coating chamber are contacted at or below room temperature either with silicon tetrachloride vapor and water vapor introduced into the chamber in separate gas streams or with silicon tetrachloride introduced in a separate stream which interacts with water associated with the coal in order to coat the surface and interstices of the coal with the reaction products of the gases, the coating step followed by elevating the chamber temperature to drive off water vapor and hydrochloric acid.

BRIEF DESCRIPTION OF THE DRAWING

The single drawing is a time-temperature graph showing the comparative responses of dried coated and uncoated coal subjected to hot water-saturated oxygen.

DESCRIPTION OF THE PREFERRED EMBODIMENTS

In accordance with the invention an extremely thin inert coating can be applied to the coal particles to exclude air from the coated part of the coal thereby inhibiting air oxidation and spontaneous burning. This inhibiting coating will last until the coal reaches the power plant and is pulverized just before firing. The net chemical reaction by which the coating material, silicon dioxide, is produced in the reaction chamber is as follows:

$$SiCl_4 + 2H_2O \rightarrow SiO_2 + 4\ HCl$$

The reactants, silicon tetrachloride, which is introduced into the chamber in a gas stream, and water, which may be introduced into the chamber as a separate gas stream or may be water associated with the coal already in the chamber, combine to form intermediate reaction products. The temperature of the coal is then elevated to drive off hydrochloric acid and water of hydration leaving a vitreous silica which adheres to the coal particles and closes most of the pores, cracks andd fissures therein.

The invention is illustrated by the following illustrative examples which are in no way limiting of the invention.

EXAMPLE 1

A sample of dried coal was treated at room temperature in a rotary glass kiln by passing over it a stream of air carrying vapors of silicon tetrachloride and water, introduced by separate injectors. Following the initial low-temperature gas phase deposition, the temperature inside the kiln was raised to 482°F (250°C), and the coated coal was allowed to cool for subsequent testing. When examined microscopically the coal particles were observed to have a coating of vitreous silica adhering to them which closed the pores, cracks and fissures in the particles. The coating was quite thin, varying up to a few microns.

Comparative tests of the self-heating characteristics of coated coal and uncoated coal were made using a testing apparatus substantially the same as that described in the article by Shea and Hsu (supra) and also as was used by Seitzer in evaluating the effectiveness of his process for stabilizing coal against spontaneous heating, which process is covered in U.S. Pat. No. 3,723,079 (supra). The results of the comparative tests of coated and uncoated coal are illustrated in the graph of the drawing in which temperature in degrees F. is plotted on the ordinate against time in hours on the abscissa. It will be noted that about 200°F (93°C) no further self-heating is noted in the dried coated coal while at about this temperature the dried uncoated coal underwent rapid self-heating and spontaneously combusted at about 350°F (177°C). The initial rise in temperature of both coated coal and uncoated coal is caused by the heat exchange from the water-saturated pure oxygen introduced at a temperature of 150°F (66°C). The samples used in the test were taken from a 27% moisture Wyodak coal, a subbituminous coal from the Powder River Basin in Wyoming.

EXAMPLE 2

A sample of raw coal (undried) containing about 27% moisture was treated below room temperature in a rotating glass kiln by passing over it a stream of nitrogen carrying vapors of silicon tetrachloride at room temperature. Water for the reaction was supplied by the coal itself. The coal warmed slightly while the silicon tetrachloride was being admitted to the chamber; this most likely was heat from the hydration of the silicon tetrachloride by water from the coal. Following the initial low-temperature gas phase deposition, the temperature in the kiln was raised to 392°F (200°C) in order to (1) dry the coal, and (2) dehydrate the coating on the coal to give it its protective coating. At a different time a second sample of the same raw (undried) coal was placed in the same rotating glass kiln; however, it was not subjected to the coating process. It was, however, dried by heating in the same fashion as was used for drying the coated coal.

Comparative tests of the self-heating characteristics of coated and uncoated coal were made as described in Example 1. The uncoated coal which was dried self heated continuously and ignited while the coated coal reached a maximum temperature which then steadily decreased, indicating that combustion would never occur under conditions of the test. The coal used in this example was from the same source as described in Example 1.

OTHER EXPERIMENTAL RESULTS

High Temperature Drying

A sample of undried coal was coated as described in Example 2. During the heating step when moisture is driven from the coal and the hydrated silica is dehydrated the temperature was raised to 572°F (300°C) followed by cooling. This coated coal was then tested for self heating, and the results were that the coated coal heated continuously up to ignition. Apparently the high drying temperature causes the coal structure to be expanded such that the coating integrity is destroyed and the hot moisture-laden oxygen of the self-heating test brings on ignition. A temperature range between about 212°F (100°C) to 572°F (300°C) is suitable for driving off water and hydrochloric acid vapors.

Hot Gas Phase Reactions

Experimentation showed that silicon dioxide will not deposit directly on coal which is at a temperature of 392°F (200°C) from the gas phase reaction of silicon tetrachloride and water to any appreciable extent.

Gas Contact for Coating

Introduction of water vapor and silicon tetrachloride vapor into the coating chamber in separate streams prevents premature hydrolysis of the silicon tetrachloride. In addition, it has been found that it is possible to prevent premature condensation of the intermediate reaction product by passing the mixed water and silicon tetrachloride vapors through a tube heated to a temperature above about 302°F (150°C). The fact that the coal is at a low temperature and is being tumbled in the rotary kiln as the separate streams of reactants are introduced ensures that practically all of the reaction occurs near the coal. Likewise, when silicon tetrachloride is vaporized prior to contact with the undried coal particles and the source of water is the coal itself, these conditions ensure that the reaction will occur at the coal particles.

PROCESS ADVANTAGES

The primary economic advantage of shipping dried coal occurs because of a reduced shipping weight resulting in lower total shipping costs or other costs based upon shipping weight. Because of moisture removal in drying coal the calorific value of the coal is raised from 8500 to 11,300 BTU for a typical sub-bituminous coal while at the same time the volume required to store one million BTU's is reduced about 25 percent. This latter savings in volume can be quite important from a transportation standpoint because of the high capital expense of railroad cars. The process makes the coal resistant to self-ignition. It also makes the coal less dusty, and this has been observed in handling the coated and uncoated coal. By microscopic observation we have observed that many small coal grains adhere to larger grains on the coated coals while this is very much less evident in uncoated coals. The coating on the coal can be expected to retard the reabsorption of moisture from the atmosphere; this effect is apparent from results of the self-heatiing test data.

From the above description of the invention, it is apparent that a process has been developed for improving coal which renders the coal resistant to spontaneous ignition with many other attendant advantages.

What is claimed is:

1. A process for making coal resistant to spontaneous combustion which comprises coating the coal in particulate form with a thin coating of silicon dioxide.

2. The process of claim 1 in which the silicon dioxide is formed in situ in the presence of the coal particles by the reaction of silicon tetrachloride and water.

3. The process of claim 2 in which the silicon tetrachloride and water are introduced into the coating chamber in separate gas streams.

4. The process of claim 3 in which each gas stream is an air stream.

5. The process of claim 2 in which the water combining with the silicon tetrachloride is derived from the coal.

6. The process of claim 5 in which the silicon tetrachloride is introduced into the coating chamber in a gas stream.

7. The process of claim 6 in which the gas stream is an air stream.

8. The process of claim 1 in which the coal particles are coated in accordance with the following process steps:

a. introducing coal particles into a coating chamber;

b. introducing silicon tetrachloride into the chamber under conditions that will promote its combination with water either introduced into the chamber in a separate stream or derived from the coal itself to form an intermediate reaction product on the surface of the coal;

c. permitting the intermediate reaction product between the silicon tetrachloride and water to form a coating on the particles; and d. raising the temperature in the chamber to drive off water and hydrochloric acid as vapors.

9. The process of claim 8 in which the coal particles are undried coal particles and the water combining with the silicon tetrachloride is derived from the undried coal particles.

10. The process of claim 8 in which the silicon tetrachloride is introduced into the coating chamber at a temperature not below the temperature of the coal particles.

11. The process of claim 8 in which the reaction between silicon tetrachloride and water in the coating chamber takes place at a temperature below about 212°F (100°C).

12. The process of claim 9 in which in step (d) the temperature in the coating chamber is raised to within a range of about 212°F (100°C) to 572°F (300°C).

13. The process of claim 8 in which the coal particles are dried coal particles and the water combining with the silicon tetrachloride is introduced into the chamber in a separate stream.

14. The process of claim 1 in which the water and silicon tetrachloride vapors are introduced through a conduit heated to at least about 302°F (150°C).

15. A new product, coal coated with an adherent coating of silicon dioxide.

16. The new product of claim 15 in which the coal is in particulate form.

* * * * *